US005792516A

United States Patent [19]

Beretta

[11] Patent Number: 5,792,516

[45] Date of Patent: Aug. 11, 1998

[54] METHOD OF DECORATING PARTS OF SMALL FIREARMS AND RESULTING PRODUCT

[75] Inventor: Ugo Gussalli Beretta, Brescia, Italy

[73] Assignee: Fabbrica D'Armi P. Beretta S.p.A., Gardone V.T., Italy

[21] Appl. No.: 668,022

[22] Filed: Jun. 19, 1996

[30] Foreign Application Priority Data

Apr. 19, 1996 [IT] Italy ..... BS96A0030

[51] Int. Cl.[6] ..... B05D 3/02; B05D 1/36

[52] U.S. Cl. ..... 427/385.5; 427/388.1; 427/407.1; 427/409; 42/106

[58] Field of Search ..... 42/2, 59, 71.01, 42/75.01, 106; 427/385.5, 388.1, 409, 407.1

[56] References Cited

U.S. PATENT DOCUMENTS

| | | | |
|---|---|---|---|
| D. 47,099 | 3/1915 | Blankenhagen | D22/105 |
| 4,268,542 | 5/1981 | Sakakibara et al. | 427/409 |
| 4,346,530 | 8/1982 | Stewart et al. | 42/71 R |
| 4,536,454 | 8/1985 | Haasl | 427/409 |
| 4,971,841 | 11/1990 | Panush et al. | 427/409 |

*Primary Examiner*—Shrive Beck
*Assistant Examiner*—Bret Chen
*Attorney, Agent, or Firm*—McGlew and Tuttle

[57] ABSTRACT

A method of decorating parts of small firearms with an enamel, lacquer or the like and a small firearm obtained with this method. The method including priming a metallic or nonmetallic part, applying the lacquer or enamel, providing a finish on the enamel or lacquer, and then applying a protective coating.

3 Claims, 1 Drawing Sheet

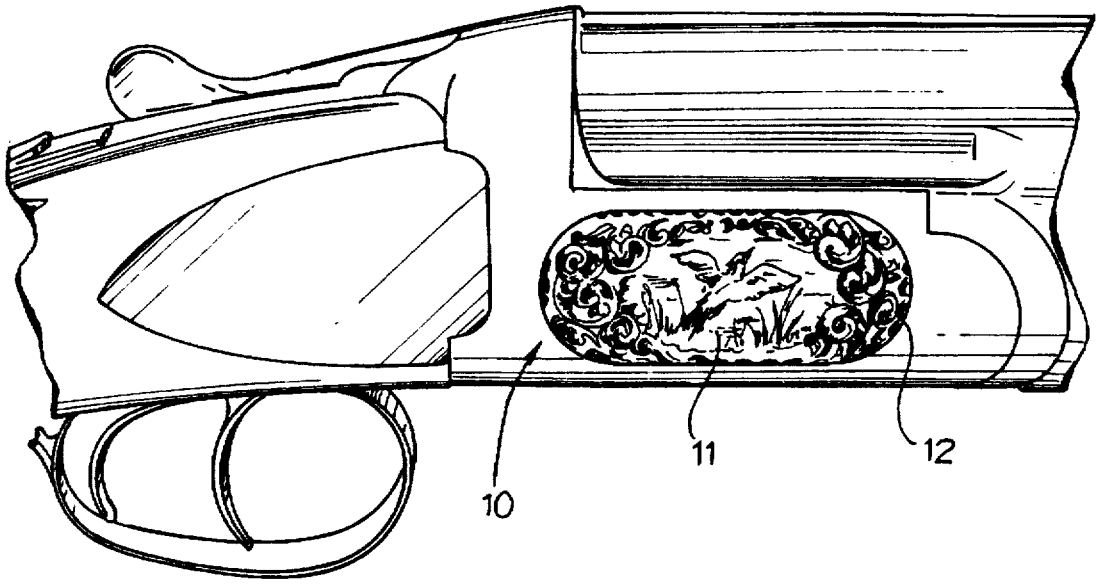
10
11
12

METHOD OF DECORATING PARTS OF SMALL FIREARMS AND RESULTING PRODUCT

FIELD OF THE INVENTION

The present invention concerns the field of small firearms and proposes specifically a novel method of decorating parts of such firearms.

BACKGROUND OF THE INVENTION

Here, small firearms are understood to be: smoothbore, semiautomatic and pump-action guns, with over-and-under or coupled barrels (double-barreled shotguns); so-called bolt-action, semiautomatic, pump-action, combined and drilling guns with rifled barrel; revolvers; semiautomatic guns, as well as flare guns and blank-cartridge guns.

Small firearms are often provided with decorated zones on metallic parts, such as the cheek plates, frames, stocks, barrel casings and bascules of rifles, and/or on nonmetallic parts, such as the butt, the stem, etc. for beautification and their personalization.

There are a number of current traditional techniques of decorating such parts of small firearms, such as engraving, photoengraving, electron discharge machining, rolling, embossing and silk-screen printing, ice finishing, marquetry, coating of various materials from mother-of-pearl to precious metals, the ornamental and protective treatments of surfaces, such as chrome-plating, nickel-plating, burnishing, nitriding; combinations thereof, etc.

Even though very different from one another, these common techniques produce traditional decorations that have well-proven performances and results. However these traditional decorations now only have limited appeal and are no longer able, on the one hand, to stimulate the creativity of the operators in the field to make original offers and, on the other hand, to stir up renewed curiosity and interest in the market.

However, the techniques of decorating with enamels, lacquers and the like, techniques, which, however, are still little known, never having been adopted in the field of small firearms, are known in other fields, in particular in construction and related fields.

SUMMARY AND OBJECTS OF THE INVENTION

The object of the present invention is to propose the application of the techniques of decorating with enamels, lacquers and like paints to small firearms with the advantages of creating novel decorations and products, which have never been proposed or commercially available and which are not even evident from the state of the art to the persons skilled in the art of firearms.

The objects and advantages are attained with a method including priming a portion of a metallic or nonmetallic part of the firearm to receive an enamel, a lacquer or other such paints. The lacquer or enamel is then applied to the primed portion of the part in a shape and arrangement corresponding to a desired decoration. Finishing is then performed on the desired decoration to provide a desired finish or surface to the decoration. A protective coating is applied to the desired decoration after the finishing to protect said desired decoration and desired finish from the surrounding environment.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

The sole Figure illustrates a decorated part of a rifle.

DETAILED DESCRIPTION OF THE PREFERRED EMBODIMENT

Referring to the figure, the method of the present invention provides for preparing the individual, firearm part 10 to be decorated by treating, if required, its surfaces mechanically and/or with a primer. An enamel, lacquer or the like 11 is manually or mechanically applied on the surfaces in shapes and arrangements corresponding to a desired decoration. If necessary, finishing and protecting the surface of the enamel, lacquer or the like decoration is performed.

Such decorations may be created either on metallic parts or on wood parts, suitably treating the surfaces according to the material. The decorations may be created directly on the concerned parts of the firearm or they may be created separately on separate components, e.g., cheek plates or another support, which can then be applied to the firearm parts to be decorated.

To better fix the enamel, lacquer or the like decorations 11 on the part on which they are created, this part may be preventively provided with frames or undercuts 12, which are suitable for binding or holding the decorative layer at least on the periphery, thus preventing its possible detachment.

In addition, the enamel, lacquer or the like decorations 11 are able to be combined or mixed with traditional decorations obtained with any of the known techniques mentioned above.

For the decorations on parts of small firearms 10 according to the present invention, enamels, lacquers or the like 11 of any color or any combination of colors may be used so as also to obtain color effects, which make possible the reproduction of the widest variety of subjects and having the advantage of more easily decorating firearm parts 10 with images that cannot easily be obtained by the usual techniques.

The resulting small firearm shall then be decorated in some of its parts with ornamental and/or personalized patterns or subjects obtained with enamels, lacquers or the like 11 with results and effects that are novel, especially when applied in the field of firearms.

While specific embodiments of the invention have been shown and described in detail to illustrate the application of the principles of the invention, it will be understood that the invention may be embodied otherwise without departing from such principles.

What is claimed is:

1. A method of decorating a firearm, the method comprising the steps of:

providing a part of the firearm;

priming a portion of the part to secure one of an enamel and a lacquer for forming a desired decoration, including mechanically treating said portion of the firearm and forming an undercut of the part of the firearm at said portion to enclose and hold said desired decoration to the part, said undercut and said decoration only being formed on said portion of the part, said undercut being positioned on a periphery of said desired decoration and said priming including applying a primer to said portion;

subsequent to said step of priming, applying said one of enamel and lacquer to said portion of the firearm in discrete locations, said discrete locations together providing a shape and arrangement of said one of enamel and lacquer when applied corresponding to said desired decoration;

finishing said one of enamel and lacquer to provide a desired finish;

applying a protective coating to said one of enamel and lacquer after said finishing to protect said desired decoration and desired finish from a surrounding environment, said desired decoration being created on said part while said part is directly on the firearm.

2. A method in accordance with claim 1, wherein:

the portion of the part is one of a metallic and nonmetallic part.

3. A method in accordance with claim 1, further comprising:

combining said one of enamel and lacquer with other firearm decorations.

* * * * *